US010872721B2

(12) United States Patent
Pradhan et al.

(10) Patent No.: US 10,872,721 B2
(45) Date of Patent: Dec. 22, 2020

(54) HIGH VOLTAGE WINDING AND A HIGH VOLTAGE ELECTROMAGNETIC INDUCTION DEVICE

(71) Applicant: ABB Power Grids Switzerland AG, Baden (CH)

(72) Inventors: Manoj Pradhan, Bålsta (SE); Abdolhamid Shoory, Buchs (CH); Jonas Ekeberg, Fislisbach (CH); Venkatesulu Bandapalle, Västerås (SE); Rafael Murillo, Saragossa (ES)

(73) Assignee: ABB POWER GRIDS SWITZERLAND AG, Baden (CH)

( * ) Notice: Subject to any disclaimer, the term of this patent is extended or adjusted under 35 U.S.C. 154(b) by 0 days.

(21) Appl. No.: 16/495,025

(22) PCT Filed: Feb. 8, 2018

(86) PCT No.: PCT/EP2018/053161

§ 371 (c)(1),
(2) Date: Sep. 17, 2019

(87) PCT Pub. No.: WO2018/171974

PCT Pub. Date: Sep. 27, 2018

(65) Prior Publication Data

US 2020/0013543 A1 Jan. 9, 2020

(30) Foreign Application Priority Data

Mar. 24, 2017 (EP) ..... 17162855

(51) Int. Cl.

| | |
|---|---|
| ***H01F 27/32*** | (2006.01) |
| ***H01F 27/24*** | (2006.01) |
| ***H01F 27/28*** | (2006.01) |

(52) U.S. Cl.
CPC ..... *H01F 27/32* (2013.01); *H01F 27/24* (2013.01); *H01F 27/288* (2013.01); *H01F 27/323* (2013.01); *H01F 2027/329* (2013.01)

(58) Field of Classification Search
CPC .... H01F 27/32; H01F 27/24; H01F 2027/329; H01F 27/323; H01F 27/288
See application file for complete search history.

(56) References Cited

U.S. PATENT DOCUMENTS

| | | | | |
|---|---|---|---|---|
| 3,387,243 A * | 6/1968 | Carpenter | ..... | H01F 27/343 336/70 |
| 6,271,743 B1 * | 8/2001 | Muller | ..... | H01F 27/2871 336/185 |
| 6,867,674 B1 * | 3/2005 | Schutte | ..... | H01F 27/2823 336/180 |

FOREIGN PATENT DOCUMENTS

| | | |
|---|---|---|
| CN | 1225743 A | 8/1999 |
| CN | 1244287 A | 2/2020 |

(Continued)

OTHER PUBLICATIONS

International Search Report and Written Opinion of the International Searching Authority Application No. PCT/EP2018/053161 Completed: Mar. 5, 2018; dated Mar. 26, 2018 13 pages.

(Continued)

*Primary Examiner* — Tuyen T Nguyen
(74) *Attorney, Agent, or Firm* — Sage Patent Group

(57) ABSTRACT

A high voltage winding for a single electrical phase of a high voltage electromagnetic induction device, wherein the high voltage winding comprises: a first winding part, and a second winding part, wherein the first winding part comprises: a first conductor, a first solid electrical insulator circumferentially enclosing the first conductor, and a first semi-conductive sheath circumferentially enclosing the first solid electrical insulator, wherein the first semi-conductive (Continued)

sheath is earthed or connected to an electric potential that is lower than a rated voltage of the high voltage winding, and wherein the second winding part comprises: a second conductor, and a second solid electrical insulator circumferentially enclosing the second conductor and forming an outermost layer of the second winding part.

19 Claims, 3 Drawing Sheets

(56) References Cited

FOREIGN PATENT DOCUMENTS

| | | | |
|---|---|---|---|
| GB | 2350476 | A | 11/2000 |
| JP | S5530877 | A | 3/1980 |
| WO | 9006584 | A1 | 6/1990 |
| WO | 9933074 | | 7/1999 |
| WO | 02061772 | A1 | 8/2002 |

OTHER PUBLICATIONS

Chinese Search Report dated Aug. 2, 2020 for CN201880018299X, 2 pages.

* cited by examiner

HIGH VOLTAGE WINDING AND A HIGH VOLTAGE ELECTROMAGNETIC INDUCTION DEVICE

TECHNICAL FIELD

The present disclosure generally relates to electromagnetic induction devices for high voltage applications. In particular, it relates to a high voltage winding for a high voltage electromagnetic induction device and to a high voltage electromagnetic induction device comprising a high voltage winding.

BACKGROUND

Electromagnetic induction devices, such as transformers and reactors, are used in power systems for voltage level control. A transformer is an electromagnetic induction device used to step up and step down voltage in electric power systems in order to generate, transmit and utilize electrical power in a cost effective manner. In a more generic sense a transformer has two main parts, a magnetic circuit, the magnetic core, made of e.g. laminated iron and an electrical circuit, windings.

When designing a high voltage electromagnetic induction device, care has to be taken so that the high voltage windings are sufficiently electrically insulated from the magnetic core, which is at ground potential, that the electromagnetic induction device is able to handle both steady-state voltages and transient over-voltages. This insulation is typically provided by an adequate clearance between the winding and the magnetic core in combination with a solid electrical insulation provided around the winding conductor.

Transient over-voltages are mainly a result of lightning-induced or switching-induced over-voltages for transformers connected to overhead lines and from circuit breaker operations. The fast fronts of transient over-voltages are not uniformly distributed along the winding, but follow the capacitive voltage distribution given by the ratio between the series capacitance between the turns along the winding and the distributed parallel capacitance to ground. The higher the ground capacitance the more non-linear is the voltage distribution and the higher the series capacitance the more linear is the voltage distribution. The non-linear voltage distribution subjects the winding turns close to the surge terminal to a voltage much above average turn voltages. The initial winding part, i.e. the part closest to the bushing, is several times more electrically stressed compared to the situation if the voltage distribution would have been linear.

According to one type of categorization of transformers, there are dry type transformers and oil-filled transformers. The former type does not have any liquid inside the tank which forms the enclosure of the dry type transformer. There is typically epoxy covering the winding of a dry type transformer. The latter type contains oil which circulates inside the tank, and acts as a dielectric and coolant.

In the case of dry type transformers, due to the limited breakdown strength of air, they are not economical for very high voltage applications. Although a dry type transformer can be designed for rather high voltage classes by the use of a large solid insulation around the winding conductor and/or by providing a large clearance between the winding and the magnetic core, such design is impaired by the poor fill factor, low current density and difficulty to regulate the voltage. To obtain a larger clearance, a larger magnetic core has to be used leading to huge amounts of no-load losses.

Oil-filled transformers also have the problem of poor fill factor due to a heavy insulation requirement because of a non-linear lightning impulse voltage distribution, albeit to a lesser extent.

WO 9006584 discloses a transformer winding that includes two types of conductors/windings. One of them has an enamel coating for providing turn-to-turn insulation. To increase the mechanical strength there is also a sheet of adhesive coated paper wound in between turns. The other type of winding/conductor used is one which comprises thin rectangular strands and is arranged in bundle sections located in the end and tap regions. Each strand is enamel-coated. The finely-stranded conductors, with thin insulation between them, formed into bundle sections ensure a high series capacitance in the coil and a linear impulse voltage distribution. This permits a reduction in the turn-to-turn, section-to-section and section-to-ground insulation clearances. The overall size of the transformer may be reduced since the number of section-to-section ducts may be reduced.

SUMMARY

Although the series capacitance in WO 9006584 provides some improved lightning impulse withstand as a result of the linear voltage distribution, it would be desired to obtain more efficient lightning impulse attenuation, as well as an even smaller clearance between the winding and the magnetic core.

In view of the above, an object of the present disclosure is to provide high voltage winding which solves or at least mitigates the problems with existing solutions.

Hence, according to a first aspect of the present disclosure there is provided a high voltage winding for a single electrical phase of a high voltage electromagnetic induction device, wherein the high voltage winding comprises: a first winding part, and a second winding part, wherein the first winding part comprises: a first conductor, a first solid electrical insulator circumferentially enclosing the first conductor, and a first semi-conductive sheath circumferentially enclosing the first solid electrical insulator, wherein the first semi-conductive sheath is earthed or connected to an electric potential that is lower than a rated voltage of the high voltage winding, and wherein the second winding part comprises: a second conductor, and a second solid electrical insulator circumferentially enclosing the second conductor and forming an outermost layer of the second winding part.

In the first winding part the electrical stress is wholly in the first solid electrical insulator in case the first semi-conductive sheath is earthed. The first winding part acts like a parallel capacitance so that an incoming lightning impulse voltage is quickly attenuated, even quicker than having high series capacitance. This effect is obtained because of the linear voltage distribution provided by the parallel capacitance to ground.

Furthermore, since the first winding part is grounded, the distance from the first winding part to the magnetic core, e.g. the yoke or limb which is at ground potential, can be reduced.

Because of the high impulse withstand of the high voltage winding, the high voltage winding may be fitted in an electromagnetic induction device which is of dry type, increasing the voltage rating of the electromagnetic induction device such that a voltage rating in the order of 500 kV may be attained, as compared to traditional dry type transformers which can be designed to a voltage rating of about 100 kV. Since the size can be reduced due to higher fill factor, an electromagnetic induction device with the indicated voltage ratings comprising the high voltage winding can be made more economical.

Due to the lower clearance distance of the first winding part to the magnetic core, the magnetic core becomes smaller and therefore the no-load losses, i.e. the magnetic core losses, may be reduced.

Furthermore, since the first winding part attenuates the lightning impulse voltage, the second winding part can have lower demands on the second solid electrical insulation thickness, and can therefore provide better heat transfer. Therefore the second conductor can be designed with higher current density, leading to savings in the conductor metal.

In case the first semi-conductive sheath is connected to an electric potential that is lower than a rated voltage of the high voltage winding, then the first solid electrical insulator can be made thinner than in the grounded case. The first winding part should in this case be placed further from the magnetic core than in the case when the first semi-conductive sheath is earthed, but the smaller volume occupied by the first solid electrical insulator will compensate for this spacing requirement from the magnetic core.

It is understood that "rated voltage" means the highest root mean square (RMS) phase-to-phase voltage in a three-phase system for which the high voltage winding is designed in respect of its insulation.

The first winding part and the second winding part have different cross-sectional structure. The first semi-conductive sheath typically forms an outer surface of the first winding part and the second solid electrical insulator forms an outer surface of the second winding part. The first solid electrical insulator forms a dielectric between the grounded/earthed first semi-conductive sheath and the first conductor, whereby turn-wise parallel capacitances are obtained. The second winding part does on the other hand not have an outer conductive sheath.

The proportion of the first winding part and the second winding part relative to the total number of turns of the high voltage winding can for example be in the range 1-70% and 99-30%, respectively. For example, the first winding part may form 10-20% of the total number of turns and the second winding part may correspondingly form 90-80% of the total number of turns.

The high voltage winding may be a primary winding or a secondary winding. Alternatively, one of the first winding part and the second winding part may form part of the primary winding while the other one of the first winding part and the second winding part may form part of the secondary winding. For example, the first winding part may form part of the primary winding and the second winding part may form part of the secondary winding of the same electrical phase.

The term "high voltage" is to be construed as a voltage equal to or higher than 22 kV.

The second winding part may be connected in series with the first winding part.

The second conductor is electrically connected to the first conductor in case the first winding part and the second winding part are series-connected. The first conductor and the second conductor are electromagnetically connected in case one of the first winding part and the second winding part forms part of the primary winding and the other one of the first winding part and the second winding part form part of the secondary winding.

According to one embodiment the first conductor has a bushing connection end configured to be connected to a bushing, the first winding part being configured to be connected between a bushing and the second winding part.

The first winding part hence acts as a surge node. The first winding part is advantageously located upstream of the second winding part when installed in a high voltage electromagnetic induction device. In this manner, it can be ensured that a lightning impulse voltage can be sufficiently attenuated before reaching the second winding part. The second solid electrical insulation may thereby be reduced compared to if the second winding part would have to absorb the front of a lightning impulse voltage.

According to one embodiment the first solid electrical insulator is made of cross-linked polyethylene, XLPE.

According to one embodiment the first solid electrical insulator is made of silicone rubber or epoxy.

According to one embodiment the second solid electrical insulator is cast in an electrically insulating material.

According to one embodiment the second solid electrical insulator comprises a resin.

According to one embodiment the second solid electrical insulator is made of Nomex®.

One embodiment comprises a second semi-conductive sheath circumferentially enclosing the first conductor, wherein the second semi-conductive sheath is arranged radially inwards of the first solid electrical insulator.

There is according to a second aspect of the present disclosure provided a high voltage electromagnetic induction device comprising: a magnetic core comprising a limb, and a high voltage winding according to the first aspect presented herein arranged around the limb.

The high voltage electromagnetic induction device may for example be a transformer, such as a power transformer, or a reactor. The high voltage electromagnetic induction device may for example be a dry type of transformer or reactor or an oil-filled transformer or reactor.

One embodiment comprises a bushing, wherein the first winding part is connected between the bushing and the second winding part.

One embodiment comprises a secondary winding, wherein the high voltage winding is a primary winding and the secondary side winding is arranged around the limb.

According to one embodiment the primary winding is arranged radially outwards of the secondary winding or the primary winding is arranged radially inwards of the secondary winding.

One embodiment comprises a cable termination configured to connect the first winding part with the second winding part.

Generally, all terms used in the claims are to be interpreted according to their ordinary meaning in the technical field, unless explicitly defined otherwise herein. All references to "a/an/the element, apparatus, component, means, etc.", are to be interpreted openly as referring to at least one instance of the element, apparatus, component, means, etc., unless explicitly stated otherwise.

BRIEF DESCRIPTION OF THE DRAWINGS

The specific embodiments of the inventive concept will now be described, by way of example, with reference to the accompanying drawings, in which.

DETAILED DESCRIPTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

Figure 1:
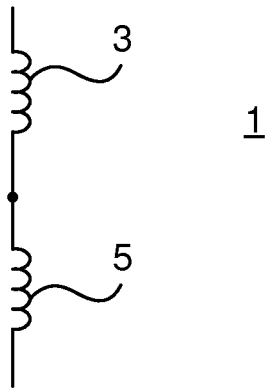
FIG. 1 schematically shows an electric circuit of a high voltage winding for a high voltage electromagnetic induction device.

FIG. 1 shows the electrical configuration of one example of a high voltage winding for single electrical phase of a high voltage electromagnetic induction device.

The high voltage winding 1 comprises a first winding part 3 and a second winding part 5. In the example, the first winding part 3 and the second winding part 5 are connected in series. In this case, the first winding part 3 and the second winding part 5 form part of the same primary winding or the same secondary winding.

Alternatively, the first winding part and the second winding part could be only electromagnetically coupled, for example if one of the first winding part and the second winding part forms part of the primary winding and the other one of the first winding part and the second winding part forms part of the secondary winding.

Figure 2A:
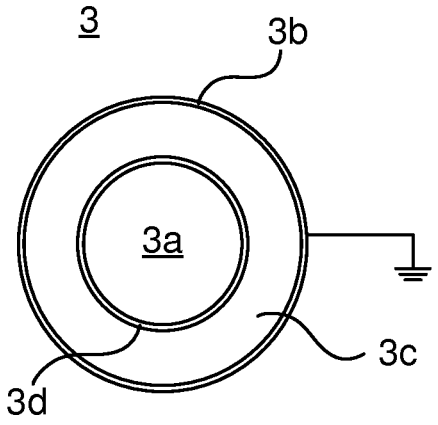
FIG. 2*a* shows a cross-section of an example of a first winding part.
Figure 2B:
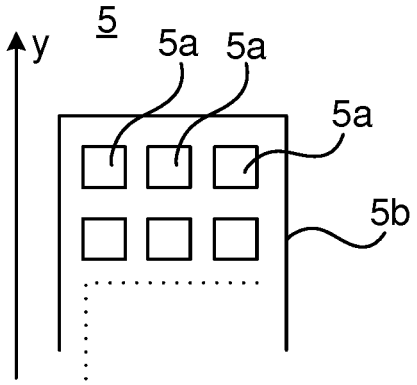
FIG. 2*b* shows a cross-section of an example of a plurality of turns of a second winding part.

Turning to FIGS. 2*a* and 2*b*, examples of the first winding part 3 and the second winding part 5 are shown. In FIG. 2*a*, the exemplified first winding part 3 comprises a first conductor 3*a*. The first conductor 3*a* is configured to carry the current through the first winding part 3. The first conductor 3*a* may for example be composed of copper or aluminum. The first conductor 3*a* may be stranded or it may be solid.

The first winding part 3 furthermore comprises a first semi-conductive sheath 3*b*. The first semi-conductive sheath 3*b* is connected to earth or ground. The first semi-conductive sheath 3*b* hence has ground potential. Alternatively, the first semi-conductive sheath 3*b* may be connected to an electric potential that is lower than a rated voltage of the high voltage winding.

The first winding part 3 also comprises a first solid electrical insulator 3*c*. The first solid electrical insulator may for example be made of cross-linked polyethylene (XLPE), silicone rubber, epoxy, Ethylene Propylene Rubber (EPR) or any material with good thermal and electrical insulating properties.

The first solid electrical insulator 3*c* circumferentially encloses the first conductor 3*a*. The first solid electrical insulator 3*c* is hence arranged radially outside of the first conductor 3*a*. The first solid electrical insulator 3*c* extends along the majority of, or along the entire, length of the first conductor 3*a*.

The first semi-conductive sheath 3*b* circumferentially encloses the first solid electrical insulator 3*c*. The first semi-conductive sheath 3*b* is hence arranged radially outside of the first solid electrical insulator 3*c*. The first semi-conductive sheath 3*b* extends along the majority of, or along the entire, length of the first solid electrical insulator 3*c*.

By means of the above-described concentric arrangement, where the first conductor 3*a* is arranged innermost, the first solid electrical insulator 3*c* is arranged between the first conductor 3*a* and the first semi-conductive sheath 3*b*, and the grounded first semi-conductive sheath 3*b* arranged radially outermost, parallel capacitance to ground may be obtained. The first solid electrical insulator 3*c* acts as a dielectric between the first conductor 3*a* and the first semi-conductive sheath 3*b*.

According to the example shown in FIG. 2*a*, the first winding part 3 also comprises a second semi-conductive sheath 3*d*. The second semi-conductive sheath 3*d* may for example be made of a semiconducting material or a conducting metal material such as copper or aluminum. The second semi-conductive sheath 3*d* circumferentially encloses the first conductor 3*a*. The second semi-conductive sheath 3*d* extends along the majority of, or along the entire, length of the first conductor 3*a*. The second semi-conductive sheath 3*d* is arranged radially inwards of the first solid electrical insulator 3*c*. Hereto, a concentric arrangement is provided with the second semi-conductive sheath 3*d* being arranged radially between the first conductor 3*a* and the first solid electrical insulator 3*c*.

FIG. 2*b* shows an example of the second winding part 5, with a plurality of turns being shown in each plane transverse to the y-axis. The y-axis indicates the axial direction of the limb around which the second winding part 5 is arranged. The second winding part 5 comprises a second conductor 5*a* and a second solid electrical insulator 5*b* circumferentially enclosing the second conductor 5*a*. The second solid electrical insulator 5*b* forms the outermost layer of the second winding part 5. In particular, the second solid electrical insulator 5*b* has a surface which forms the outer surface of the second winding part 5.

The second solid electrical insulator 5*b* may be realized in a number of ways. The second solid electrical insulator 5*b* may for example be a casting of an electrically insulating material such as a resin e.g. epoxy. In this case the second solid electrical insulator 5*b* may be referred to as closed because all of the turns are insulated by a block formed by the second solid electrical insulator 5*b*. A closed example is shown in FIG. 2*b*. Other examples of the solid electrical insulator 5*b* are Nomex®, or a cellulose-based insulator, both of which provide an open second winding part in the sense that each turn is individually insulated.

The cross-sectional topology, or cross-sectional structure, hence differs between the first winding part 3 and the second winding part 5. The first winding part 3 has only a ground capacitance obtained by the configuration of first conductor 3*a*, the first solid electrical insulator 3*c* and the grounded first semi-conductive sheath 3*b*. The second winding part 5 does not have this ground capacitor like structure but only a series capacitance between the turns. In the case that the first semi-conductive sheath is connected to an electric potential that is lower than a rated voltage of the high voltage winding, then the capacitive network will be similar to that of a traditional winding, i.e. it has both series and ground capacitance.

Figure 3A:
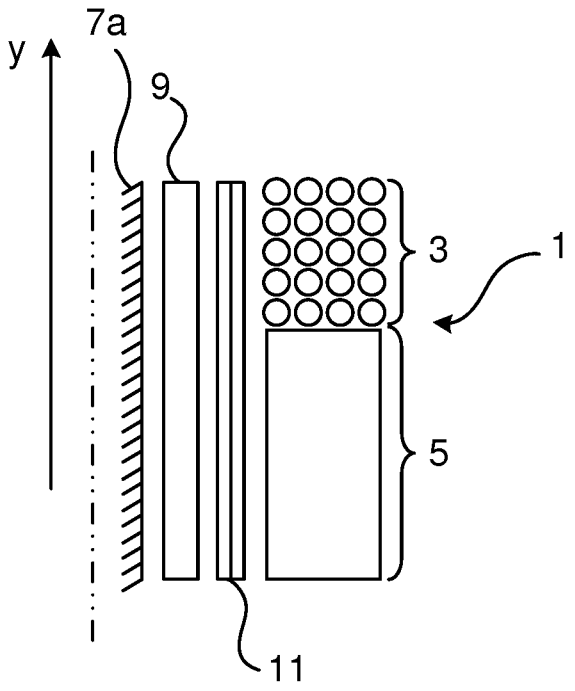
FIGS. 3*a*-3*c* depict longitudinal sections along the axial extension of a limb of a magnetic core of a number of different examples of a high voltage winding.

FIG. 3*a* shows an example of a high voltage winding 1 arranged around a limb 7*a* of a magnetic core of a high voltage electromagnetic induction device provided with a bushing. In this example, there is a secondary winding 9 provided closest to and adjacent to the limb 7*a* and a first barrier 11 arranged radially outside of the secondary winding 9. The high voltage winding 1 is arranged radially outside of the barrier 11. The first barrier 11 hence separates the high voltage winding 1 from the secondary winding 9.

The first winding part 3 forms a first section of the high voltage winding 1 in the y-direction, i.e. the axial direction of the limb 7. The second winding part 5 forms a second section of the high voltage winding 1, arranged axially spaced apart from the first section and thus from the first winding part 3. The first winding part 3 may be arranged vertically above the second winding part 5. The first winding part 3 may in particular be arranged closer to a bushing terminal. The first winding part 3 is beneficially located between the bushing terminal of the bushing and the second winding part 5. The first winding part 3 may have a bushing connection end which is connected to the bushing terminal and another end connected to the second winding part 5. The first winding part 3 will thereby attenuate a lightning impulse voltage or other transient entering the high voltage electromagnetic induction device via the bushing before it reaches the second winding part 5.

Figure 3B:
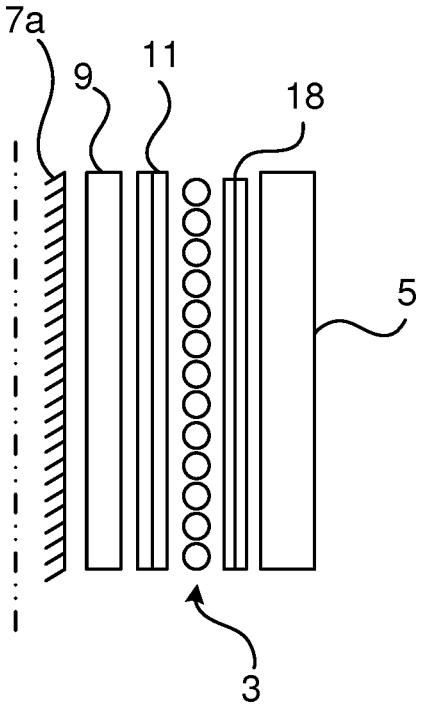

FIG. 3*b* shows another example of the high voltage winding 1 arranged around the limb 7*a* of a magnetic core of a high voltage electromagnetic induction device. In this example, the secondary winding 9 is arranged closest to and adjacent to the limb 7*a* and the first barrier 11 is arranged radially outside of the secondary winding 9. The first winding part 3 is arranged radially outside of the first barrier 11 and a second barrier 13 is arranged radially outside of the first winding part 3. The second winding part 5 is arranged radially outside of the second barrier 13. The second winding part 5 is hence arranged outermost in the configuration depicted in FIG. 3*b*.

Figure 3C:
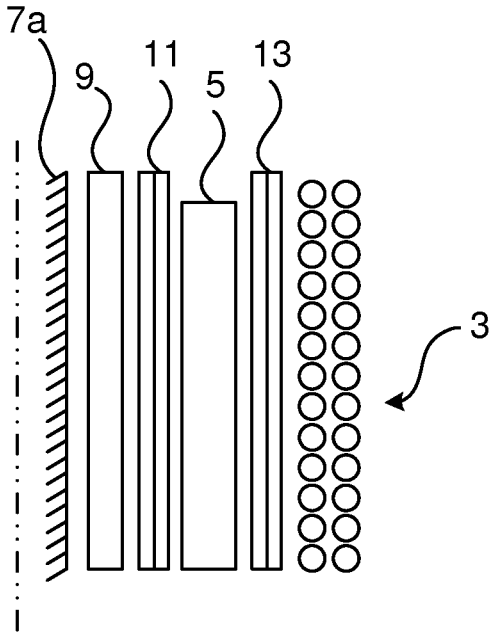

FIG. 3*c* shows yet another example of a high voltage winding 1 arranged around the limb 7*a* of a magnetic core of a high voltage electromagnetic induction device. In this example the secondary winding 9 is arranged closest to and adjacent to the limb 7*a* and the first barrier 11 is arranged radially outside of the secondary winding 9. The second winding part 5 is arranged radially outside of the first barrier 11 and a second barrier 13 is arranged radially outside of the second winding part 5. The first winding part 3 is arranged radially outside of the second barrier 13. The first winding part 3 is hence arranged outermost in the configuration depicted in FIG. 3*c*. Since the first winding part 3 has the first semi-conductive sheath 3*b* as its outmost layer, the external surface of the first winding part 3 will be at ground potential. The first winding part 3 will hence need essentially no clearance towards the adjacent limb, not shown, of the magnetic core.

It is to be noted that a great plurality of variations of how the high voltage winding is disposed around the limb is envisaged. For example, the high voltage winding disclosed herein may form the secondary winding or the primary winding, or both. Moreover, according to one example the first winding part may form part of the primary winding and the second winding part may form of the secondary winding. Additionally, the primary winding may alternatively be located radially inwards of the secondary winding, instead of the configuration shown in FIGS. 3*a*-3*c*.

Furthermore, according to one example, a certain voltage potential may be achieved in the first semi-conductive sheath by connecting a middle tap of the high voltage winding to the conductive sheath to obtain a different stress distribution. The thickness of the first solid electrical insulation may thereby be reduced, and the capacitance of the first winding part may be increased.

Additionally, according to one variation, the high voltage winding may comprise two first winding parts and one second winding part. In this case, the second winding part may be sandwiched between the two first winding parts. This configuration is particularly useful in the case of an electromagnetic induction device having uniform insulation because the two first winding parts will provide transient attenuation from both directions towards the second winding part.

In case the first winding part 3 and the second winding part 5 both form part of the same primary winding or secondary winding, the first winding part 3 and the second winding part 5 may be connected by means of a cable termination.

Figure 4:
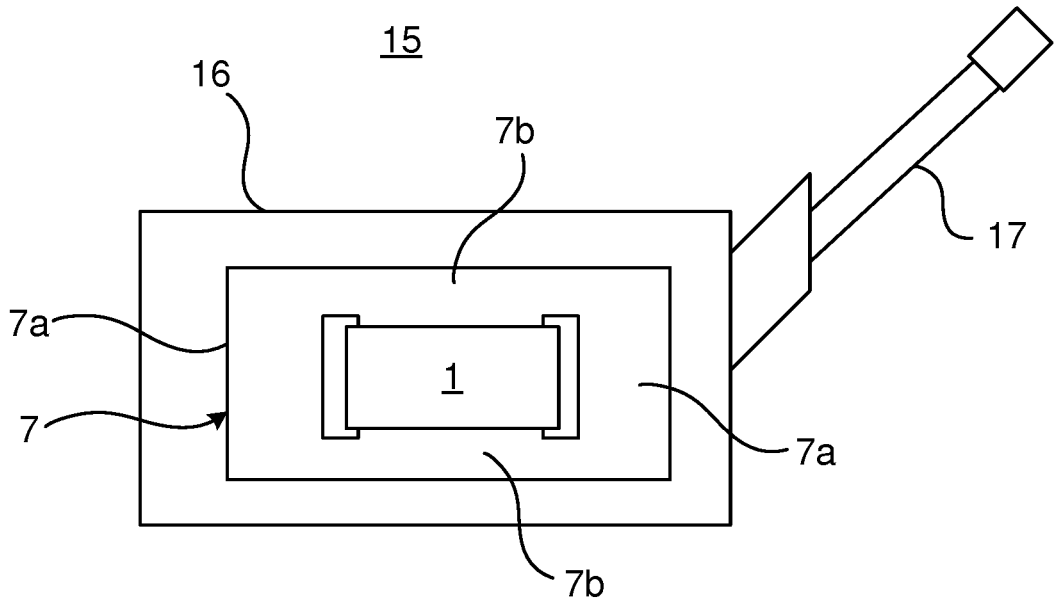
FIG. 4 is a schematic sectional view of an example of a high voltage electromagnetic induction device including a high voltage winding.

FIG. 4 shows a high voltage electromagnetic induction device 15, typically a power transformer or a reactor. The high voltage electromagnetic induction device 15 comprises tank or enclosure 16, a bushing 17 extending into the tank 16, a magnetic core 7 comprising limbs 7*a* and yokes 7*b*, and a high voltage winding 1. The high voltage winding 1 is arranged around a limb 7*a*, in this example the central limb. The first semi-conductive sheath 3*b* of the first winding part 3 is grounded/earthed and typically has the same voltage potential as the magnetic core 7.

The windings of each electrical phase of a high voltage electromagnetic induction device may beneficially have the structure as disclosed herein.

According to one example, the electromagnetic induction device may comprise a tap changer and regulating winding connected to the tap changer by means of a plurality of tap changer cables. Each such tap changer cable may according to this example be of the same type as the first winding part. To this end, each tap changer cable comprises a conductor, a solid electrical insulator arranged around the conductor, and a semi-conductive sheath arranged around the solid electrical insulator. The semi-conductive sheath of each tap changer cable may be earthed or connected to a common electric potential. The tap changer cables may, since their outer surface is at the same electric potential, be bundled. The tap changer cable bundle thus obtained will thereby occupy less space within the enclosure of the electromagnetic induction device.

The inventive concept has mainly been described above with reference to a few examples. However, as is readily appreciated by a person skilled in the art, other embodiments than the ones disclosed above are equally possible within the scope of the inventive concept, as defined by the appended claims.

The invention claimed is:

1. A high voltage winding for a single electrical phase of a high voltage electromagnetic induction device, wherein the high voltage winding comprises:

a first winding part, and a second winding part, wherein the first winding part includes:

a first conductor, a first solid electrical insulator circumferentially enclosing the first conductor, and a first semi-conductive sheath circumferentially enclosing the first solid electrical insulator, wherein the first semi-conductive sheath is earthed or connected to an electric potential that is lower than a rated voltage of the high voltage winding, and wherein the second winding part includes:

a second conductor, and a second solid electrical insulator circumferentially enclosing the second conductor and forming an outermost layer of the second winding part.

2. The high voltage winding as claimed in claim 1, wherein the first conductor has a bushing connection end configured to be connected to a bushing, the first winding part being configured to be connected between a bushing and the second winding part.

3. The high voltage winding as claimed in claim 1, wherein the first solid electrical insulator is made of cross-linked polyethylene, XLPE.

4. The high voltage winding as claimed in claim 1, wherein the first solid electrical insulator is made of silicone rubber or epoxy.

5. The high voltage winding as claimed in claim 1, wherein the second solid electrical insulator is cast in an electrically insulating material.

6. The high voltage winding as claimed in claim 5, wherein the second solid electrical insulator includes a resin.

7. The high voltage winding as claimed in claim 1, wherein the second solid electrical insulator is made of Nomex®.

8. The high voltage winding as claimed in claim 1, comprising a second semi-conductive sheath circumferentially enclosing the first conductor, wherein the second semi-conductive sheath is arranged radially inwards of the first solid electrical insulator.

9. A high voltage electromagnetic induction device comprising:

a magnetic core including a limb, and a high voltage winding arranged around the limb and having:

a first winding part, and a second winding part, wherein the first winding part includes:

a first conductor, a first solid electrical insulator circumferentially enclosing the first conductor, and a first semi-conductive sheath circumferentially enclosing the first solid electrical insulator, wherein the first semi-conductive sheath is earthed or connected to an electric potential that is lower than a rated voltage of the high voltage winding, and wherein the second winding part includes:

a second conductor, and a second solid electrical insulator circumferentially enclosing the second conductor and forming an outermost layer of the second winding part.

10. The high voltage electromagnetic induction device as claimed in claim 9, comprising a bushing, wherein the first winding part is connected between the bushing and the second winding part.

11. The high voltage electromagnetic induction device as claimed in claim 9, comprising a secondary winding, wherein the high voltage winding is a primary winding and the secondary side winding is arranged around the limb.

12. The high voltage electromagnetic induction device as claimed in claim 11, wherein the primary winding is arranged radially outwards of the secondary winding or the primary winding is arranged radially inwards of the secondary winding.

13. The high voltage electromagnetic induction device as claimed in claim 9, comprising a cable termination configured to connect the first winding part with the second winding part.

14. The high voltage winding as claimed in claim 2, wherein the first solid electrical insulator is made of cross-linked polyethylene, XLPE.

15. The high voltage winding as claimed in claim 2, wherein the first solid electrical insulator is made of silicone rubber or epoxy.

16. The high voltage winding as claimed in claim 2, wherein the second solid electrical insulator is cast in an electrically insulating material.

17. The high voltage winding as claimed in claim 2, wherein the second solid electrical insulator is made of Nomex®.

18. The high voltage winding as claimed in claim 2, comprising a second semi-conductive sheath circumferentially enclosing the first conductor, wherein the second semi-conductive sheath is arranged radially inwards of the first solid electrical insulator.

19. The high voltage electromagnetic induction device as claimed in claim 10, comprising a secondary winding, wherein the high voltage winding is a primary winding and the secondary side winding is arranged around the limb.

* * * * *